US010988829B2

(12) United States Patent
Wolf et al.

(10) Patent No.: US 10,988,829 B2
(45) Date of Patent: Apr. 27, 2021

(54) METHOD FOR PRODUCING NICKEL ALLOYS WITH OPTIMIZED STRIP WELDABILITY

(71) Applicant: VDM Metals International GmbH, Werdohl (DE)

(72) Inventors: Martin Wolf, Dortmund (DE); Stefan Gilges, Altena (DE); Jens Koepernik, Neuenrade (DE)

(73) Assignee: VDM Metals International GmbH, Werdohl (DE)

( * ) Notice: Subject to any disclaimer, the term of this patent is extended or adjusted under 35 U.S.C. 154(b) by 201 days.

(21) Appl. No.: 16/348,736

(22) PCT Filed: Dec. 8, 2017

(86) PCT No.: PCT/DE2017/101050

§ 371 (c)(1),
(2) Date: May 9, 2019

(87) PCT Pub. No.: WO2018/113830

PCT Pub. Date: Jun. 28, 2018

(65) Prior Publication Data

US 2019/0284662 A1 Sep. 19, 2019

(30) Foreign Application Priority Data

Dec. 21, 2016 (DE) ..... 10 2016 125 123.2

(51) Int. Cl.
*C22C 1/02* (2006.01)
*C22C 19/05* (2006.01)
*C22F 1/10* (2006.01)

(52) U.S. Cl.
CPC ..... *C22C 1/023* (2013.01); *C22C 19/05* (2013.01); *C22C 19/051* (2013.01);
(Continued)

(58) Field of Classification Search
CPC ..... C22C 1/023; C22C 19/055; C22C 19/056; C22F 1/10
See application file for complete search history.

(56) References Cited

U.S. PATENT DOCUMENTS 5,529,642 A 6/1996 Sugahara et al.
2016/0289807 A1 10/2016 Hattendorf

FOREIGN PATENT DOCUMENTS

CA 2 291 051 A1 12/1998
CN 1249010 A 3/2000
(Continued)

OTHER PUBLICATIONS

Japanese Notice for Reasons for Refusal in JP 2019-533627, dated Aug. 11, 2020.
(Continued)

*Primary Examiner* — Jessee R Roe
(74) *Attorney, Agent, or Firm* — Collard & Roe, P.C.

(57) ABSTRACT

The invention relates to methods for the manufacture of nickel alloys having optimized strip weldability (TIG without filler) from an alloy of the following composition (in wt %): C max. 0.05%, Co max. 2.5%, Ni the rest, especially >35-75.5%, Mn max. 1.0%, Si max. 0.5%, Mo >2 to 23%, P max. 0.2%, S max. 0.05%, N up to 0.2%, Cu ≤1.0%, Fe >0 to ≤7.0%, Ti >0 to <2.5%, Al >0 to 0.5%, Cr >14 to <25%, V max. 0.5%, W up to 3.5%, Mg up to 0.2%, Ca up to 0.02%, in that the alloy is smelted openly and cast as ingots, the ingots are subjected if necessary to at least one heat treatment, the ingots are then remelted at least one time by electroslag refining, the remelted ingot obtained in this way is subjected if necessary to at least one heat treatment, the ingot is subjected to at least one cold and/or hot deformation cycle, until strip material of predeterminable
(Continued)

material thickness exists, the strip material is subdivided into strip sections of defined lengths/widths.

7 Claims, 1 Drawing Sheet

(52) U.S. Cl.
CPC ..... *C22C 19/055* (2013.01); *C22C 19/056* (2013.01); *C22F 1/10* (2013.01)

(56) References Cited

FOREIGN PATENT DOCUMENTS

| | | | |
|---|---|---|---|
| DE | 69404937 | T2 | 1/1998 |
| DE | 10 2009 010 026 | A1 | 8/2010 |
| DE | 10 2014 001328 | A1 | 8/2015 |
| EP | 0 392 484 | A1 | 10/1990 |
| EP | 0 693 565 | A2 | 1/1996 |
| EP | 0 991 788 | B1 | 8/2001 |
| JP | H07-316697 | A | 12/1995 |
| JP | 2001-179486 | A | 7/2001 |
| JP | 2005-118875 | A | 5/2005 |
| JP | 2014-073516 | A | 4/2014 |

OTHER PUBLICATIONS

Written Amendment in JP 2019-533627, dated Nov. 6, 2020.
Written Opinion in JP 2019-533627, dated Nov. 6, 2020.
Chinese Office Action CN 201780072730.4, dated Jul. 6, 2020 with Chinese Search Report dated Jun. 18, 2020.
J. Ishizaka and 4 other authors, Herstellung and Bewertung van grolssen Legierungen auf Ni-Basis fuer kryogene Strukturmaterialien, The Iron and Stell Institute of Japan, Current Advances in Materials and Processes, report of the ISIJ meeting, Sep. 28, 1998, 116th (Autumn), CAMP-ISIJ vol. 1 (1988)—1904, Manufacturing and Evaluation of Large Ni-Base Alloy for Cryogenic Structural Material (see Japanese Notification of Reasons for Refusal for relevance).
Inconel Alloy 718, downloaded Nov. 18, 2020, 1 page.
Nickel Alloy A286, United Performance Metals, downloaded Nov. 18, 2020,1 page.
Korean Written Opinion in KR 10-2019-7016724, dated Oct. 27, 2020.
English translation of the International Preliminary Report on Patentability and Written Opinion of International Searching Authority in PCT/DE2017/101050, dated Jul. 4, 2019.
International Search Report in PCT/DE2017/101050, dated Feb. 20, 2018.

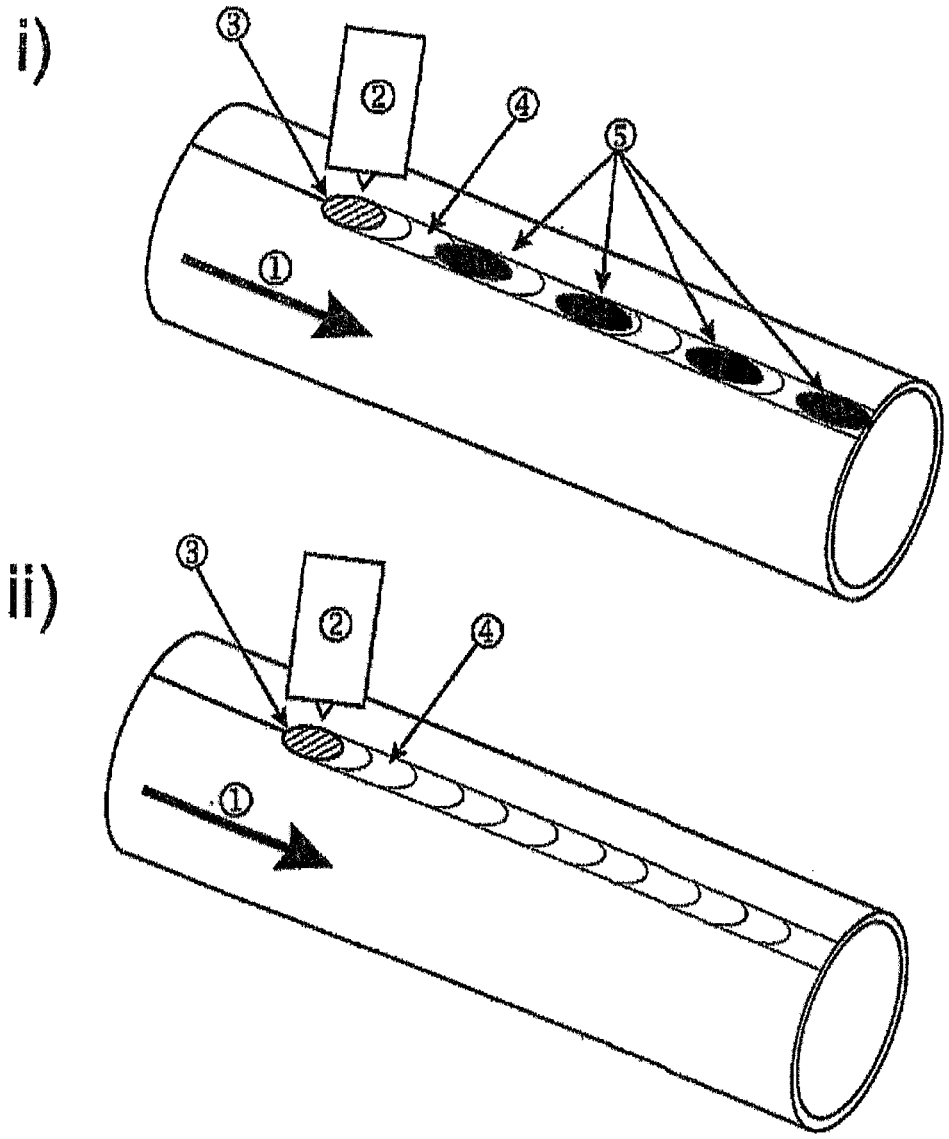
i)
③
②
④
⑤
①
ii)
③
②
④
①

METHOD FOR PRODUCING NICKEL ALLOYS WITH OPTIMIZED STRIP WELDABILITY

CROSS REFERENCE TO RELATED APPLICATIONS

This application is the National Stage of PCT/DE2017/101050 filed on Dec. 8, 2017, which claims priority under 35 U.S.C. § 119 of German Application No. 10 2016 125 123.2 filed on Dec. 21, 2016, the disclosure of which is incorporated by reference. The international application under PCT article 21 (2) was not published in English.

The invention relates to a method for the manufacture of nickel alloys having optimized strip weldability, especially in TIG without filler.

EP 0 991 788 B1 discloses a nickel-chromium-molybdenum alloy having high corrosion resistance toward oxidizing and reducing media, consisting of the following composition (in mass %):

| | |
|---|---|
| Cr | 20.0 to 23.0% |
| Mo | 18.5 to 21.0% |
| Fe | max. 1.5% |
| Mn | max. 0.5% |
| Si | max. 0.10% |
| Co | max. 0.3% |
| W | max. 0.3% |
| Cu | max. 0.3% |
| Al | 0.1 to 0.3% |
| Mg | 0.001 to 0.15% |
| Ca | 0.001 to 0.010% |
| C | max. 0.01% |
| N | 0.05 to 0.15% |
| V | 0.1 to 0.3% |

the rest nickel and further smelting-related impurities.

This alloy may be used for structural parts in chemical systems.

The objective of the subject matter of the invention is to provide a method for the manufacture of nickel alloys that has an improved weldability compared with the prior art.

This objective is accomplished by a method for the manufacture of nickel alloys having optimized strip weldability (TIG without filler) from an alloy of the following composition (in wt %):

| | |
|---|---|
| C | max. 0.05% |
| Co | max. 2.5% |
| Ni | the rest, especially >35 to 75.5% |
| Mn | max 1.0% |
| Si | max. 0.5% |
| Mo | >2 to 23% |
| P | max. 0.2% |
| S | max. 0.05% |
| N | up to 0.2 |
| Cu | ≤1.0% |
| Fe | >0 to ≤7.0% |
| Ti | >0 to <2.5% |
| Al | >0 to 0.5% |
| Cr | >14 to <25% |
| V | max. 0.5% |
| W | up to 3.5% |

-continued

| | |
|---|---|
| Mg | up to 0.2% |
| Ca | up to 0.02% |

in that the alloy is smelted openly and cast as ingots, the ingots are subjected if necessary to at least one heat treatment, the ingots are then remelted at least one time by electroslag refining, the remelted ingot obtained in this way is subjected if necessary to at least one heat treatment, the ingot is subjected to at least one cold and/or hot deformation cycle, until strip material of predeterminable material thickness exists, the strip material is subdivided into strip sections of defined lengths/widths.

Advantageous further developments of the method according to the invention can be inferred from the associated dependent claims.

The alloy may also have the following composition (in wt %):

| | |
|---|---|
| C | max. 0.025% |
| Co | max. 2.5% |
| Ni | the rest, especially >35 to <75% |
| Mn | 0.01 up to max. 1.0% |
| Si | 0.01 up to max. 0.5% |
| Mo | 2.5 to <23% |
| P | max. 0.1% |
| S | max. 0.02% |
| Cu | 0.01 up to ≤1.0% |
| Fe | >0 to <7.0% |
| Ti | >0 to 1.5% |
| Al | >0 to 0.4% |
| Cr | 14.5 to <25% |
| V | max. 0.35% |
| W | up to 3.5% |
| Mg | up to 0.05% |
| Ca | up to 0.02% |

Preferably, the subject matter of the invention is intended to be applicable to alloys such as Alloy 59, Alloy 2120, Alloy C-22 as well as Alloy C4.

The method according to the invention can be preferably used for the manufacture of longitudinally seam-welded pipes, wherein the longitudinal seam welding advantageously takes place on the basis of a fusion-welding method, especially the TIG welding method without filler.

For this purpose it was possible to improve the TIG weldability of nickel materials significantly without the use of filler metals as strip material in the thickness range between 0.5 mm and 3.5 mm solely by remelting the material by means of the "electroslag refining method". The "flotation"—which heretofore has limited the welding process—of oxide constituents in the weld pool (mainly of Mg, Ca, Al oxides) from the deoxidation process or the furnace wall may be effectively suppressed hereby, and the so-called welding-process window (ranges of settings for welding current, welding voltage, welding speed) may be greatly widened.

These technical advantages are unexpected insofar as the original chemical composition of the material from the ingot casting also does not undergo any noteworthy change—due to the electroslag refining—with respect to the elements that are important for the hot forming, such as Mg, Ca, Al, Ti. It is known that the electroslag refining leads to a homogenization of the material and thus to an improvement of, for example, the hot forming. It is indeed also known that the inclusion inventory of a material is changed by application of the electroslag refining method. However, the positive effect of the electroslag refining on the TIG weldability of a nickel alloy as strip material is surprising and heretofore has not been proved.

Table 1 shows the general chemical composition of the materials Alloy 59, Alloy 2120, C4 and C-22:

TABLE 1

| | Alloy 59 | | Alloy 2120 | | C-22 | | C4 | |
|---|---|---|---|---|---|---|---|---|
| | min. | max. | min. | max. | min. | max. | min. | max. |
| C | | 0.010 | | 0.01 | | 0.01 | | 0.009 |
| Co | | 0.3 | | 0.3 | | 2.5 | | 2.0 |
| Ni | | rest | | rest | | rest | | rest |
| Mn | | 0.5 | | 0.5 | | 0.5 | | 1.0 |
| Si | | 0.10 | | 1.0 | | 0.08 | | 0.05 |
| Mo | 15.0 | 16.5 | 18 | 22 | 12.5 | 14.5 | 2.5 | 17 |
| P | | 0.015 | | | | 0.025 | | 0.02 |
| S | | 0.015 | | | | 0.01 | | 0.01 |
| Cu | | 0.5 | | 0.3 | | | | 3 |
| Fe | | 1.5 | | 1.5 | 2.0 | 6.0 | | 5 |
| Ti | | | | | | | | 0.7 |
| Al | 0.1 | 0.4 | 0.1 | 0.3 | | | | 0.4 |
| Cr | 22.0 | 24.0 | 19.5 | 23.0 | 20.0 | 22.5 | 14.5 | 17.5 |
| W | | | | 0.3 | 2.5 | 3.5 | | 3.5 |
| V | | | | 0.3 | | 0.35 | | |

The subject matter of the invention will be illustrated on the basis of an example as follows:

In Table 2, a batch (317889) of the alloy (Alloy 59) generally indicated in Table 1 is indicated:

TABLE 2

| Element | Mass % |
|---|---|
| C | 0.005 |
| Cr | 22.8 |
| Ni | 59.9 |
| Mn | 0.16 |
| Si | 0.03 |
| Mo | 15.4 |
| Ti | 0.01 |
| Nb | 0.02 |
| Cu | 0.01 |
| Fe | 1.25 |
| P | 0.005 |
| Al | 0.08 |
| Mg | 0.002 |
| V | 0.15 |
| W | 0.17 |
| Co | 0.02 |

This alloy was smelted openly and cast as ingots. These ingots were then remelted by electroslag refining. The ingots obtained in this way were subjected to a heat treatment in the temperature range of 1150° C. to 1200° C. and hot-rolled to slabs having an edge length of 180 mm×765 mm. By further cold or hot deformations, strip material was produced in the thickness of 1.650 mm and subdivided into strip sections with the width of 77.0 mm.

The strip material was then reformed as an open pipe, wherein the abutting ends of the open pipe situated opposite one another are joined to one another by longitudinal seam welding for formation of a closed pipe.

The following TIG welding parameters were used for the manufacture of longitudinally seam-welded pipes: voltage U=13 V, current I=190 A, shield gas=pure argon 4.6, welding speed=1.2 m/min.

With these parameters, it was possible to manufacture longitudinally seam-welded pipes without the occurrence of oxide deposits. Hereby it was possible to reduce the defect and rejects rate after welding to almost zero.

The following conditions are represented in the sketch.

Material condition i) strip material openly smelted, but without electroslag refining:

1. Direction of movement of the strip formed as pipe;
2. Stationary TIG welding torch, without use of filler metal;
3. Weld pool for generation of a substance-to-substance bond of the strip edges;
4. Weld seam;
5. Undesired, periodic oxide deposits on the top and/or bottom side of the weld seam.

Material condition ii) strip material with electroslag refining:

1. Direction of movement of the strip formed as pipe;
2. Stationary TIG welding torch, without use of filler;
3. Weld pool for generation of a substance-to-substance bond of the strip edges;
4. Weld seam.

The invention claimed is:

1. A method for the manufacture of nickel alloys having strip weldability from an alloy of the following composition (in wt %):

| | |
|---|---|
| C | max. 0.05% |
| Co | max. 2.5% |
| Ni | >35 to 75.5% |
| Mn | max 1.0% |
| Si | max. 0.5% |
| Mo | >2 to 23% |
| P | max. 0.2% |
| S | max. 0.05% |
| N | up to 0.2% |
| Cu | ≤1.0% |
| Fe | >0 to ≤7.0% |
| Ti | >0 to <2.5% |
| Al | >0 to 0.5% |
| Cr | >14 to <25% |
| V | max. 0.5% |
| W | up to 3.5% |
| Mg | up to 0.2% |
| Ca | up to 0.02% |

wherein the alloy is smelted openly and cast as ingots, the ingots are subjected if necessary to at least one heat treatment, the ingots are then remelted at least one time by electroslag refining, the remelted ingot obtained in this way is subjected if necessary to at least one heat treatment, the ingot is subjected to at least one cold and/or hot deformation cycle, until strip material of predeterminable material thickness exists, the strip material is subdivided into strip sections of defined lengths/widths, the strip sections are reformed as an open pipe, and the abutting ends of the open pipe situated opposite one another are joined to one another by longitudinal seam welding for formation of a closed pipe.

2. The method for the manufacture of nickel alloys having strip weldability according to claim 1 from an alloy of the following composition (in wt %):

| | |
|---|---|
| C | max. 0.025% |
| Co | max. 2.5% |

-continued

| | |
|---|---|
| Ni | >35 to <75% |
| Mn | 0.01 up to max. 1.0% |
| Si | 0.01 up to max. 0.5% |
| Mo | 2.5 to <23% |
| P | max. 0.1% |
| S | max. 0.02% |
| N | up to 0.2% |
| Cu | 0.01 up to max. 1.0% |
| Fe | >0 to ≤7% |
| Ti | >0 to 1.5% |
| Al | >0 to 0.4% |
| Cr | 14.5 to <25% |
| V | max. 0.35% |
| W | up to 3.5% |
| Mg | up to 0.1% |
| Ca | up to 0.02% |

wherein the alloy is smelted openly and cast as ingots, the ingots are subjected if necessary to at least one heat treatment, the ingots are then remelted at least one time by electroslag refining, the remelted ingot obtained in this way is subjected if necessary to at least one heat treatment, the ingot is subjected to at least one cold and/or hot deformation cycle, until strip material of predeterminable material thickness exists, the strip material is separated into strip sections of defined lengths/widths.

3. The method according to claim 1, wherein an alloy of the following composition (in wt %) is used as the material:

| | |
|---|---|
| C | max. 0.010% |
| Co | max. 0.3% |
| Ni | the rest |
| Mn | max 0.5% |
| Si | max. 0.10% |
| Mo | 15.0 to 16.5% |
| P | max. 0.015% |
| S | max. 0.015% |
| Cu | ≤0.5% |
| Fe | max. 1.5% |

-continued

| | |
|---|---|
| Al | 0.1 to 0.4% |
| Cr | 22.0 to 24.0. |

4. The method according to claim 1, wherein an alloy of the following composition (in wt %) is used as the material:

| | |
|---|---|
| C | max. 0.01% |
| Co | max. 2.5% |
| Ni | the rest |
| Mn | max 0.5% |
| Si | max. 0.08% |
| Mo | 12.5 to 14.5% |
| P | max. 0.025% |
| S | max. 0.01% |
| Fe | 2.0 to ≤6.0% |
| Cr | 20.0 to 22.5 |
| V | max. 0.35% |
| W | 2.5 to 3.5%. |

5. The method according to claim 1, wherein an alloy of the following composition (in wt %) is used as the material:

| | |
|---|---|
| C | max. 0.009% |
| Co | max. 2.0% |
| Ni | the rest |
| Mn | max 1.0% |
| Si | max. 0.05% |
| Mo | 2.5 to 17% |
| P | max. 0.02% |
| S | max. 0.01% |
| Cu | ≤3% |
| Fe | max 5% |
| Ti | 0.7% |
| Al | max. 0.4% |
| Cr | 14.5 to 17.5 |
| W | max. 3.5%. |

6. The method according to claim 1, wherein the longitudinal seam welding of the open pipe takes place on the basis of a fusion-welding method.

7. The method according to claim 1, wherein the longitudinal seam welding of the open pipe takes place on the basis of a TIG welding method without filler.

* * * * *